US010844667B2

(12) United States Patent
Tilleman et al.

(10) Patent No.: US 10,844,667 B2
(45) Date of Patent: Nov. 24, 2020

(54) DRILL BIT HAVING SHAPED IMPREGNATED SHOCK STUDS AND/OR INTERMEDIATE SHAPED CUTTER

(71) Applicant: VAREL INTERNATIONAL IND., L.L.C., Carrollton, TX (US)

(72) Inventors: Daniel Michael Tilleman, Calgary (CA); Duncan Michael McAllister, Oklahoma City, OK (US); Bruno Cuillier De Maindreville, Pau (FR)

(73) Assignee: VAREL INTERNATIONAL IND., L.L.C., Carrollton, TX (US)

( * ) Notice: Subject to any disclaimer, the term of this patent is extended or adjusted under 35 U.S.C. 154(b) by 150 days.

(21) Appl. No.: 16/113,169

(22) Filed: Aug. 27, 2018

(65) Prior Publication Data

US 2019/0106943 A1 Apr. 11, 2019

Related U.S. Application Data

(60) Provisional application No. 62/570,276, filed on Oct. 10, 2017, provisional application No. 62/688,061, filed on Jun. 21, 2018.

(51) Int. Cl.
*E21B 10/43* (2006.01)
*E21B 10/567* (2006.01)

(52) U.S. Cl.
CPC ..... *E21B 10/5673* (2013.01); *E21B 10/43* (2013.01)

(58) Field of Classification Search
CPC .... E21B 10/5673; E21B 10/43; E21B 10/567; E21B 10/56; E21B 10/42; E21B 10/54; E21B 10/36
See application file for complete search history.

(56) References Cited

U.S. PATENT DOCUMENTS

| | | | | |
|---|---|---|---|---|
| 4,602,691 | A | 7/1986 | Weaver | |
| 5,544,713 | A | 8/1996 | Dennis | |
| 5,595,252 | A | 1/1997 | O'Hanlon | |
| 5,678,645 | A * | 10/1997 | Tibbitts | E21B 10/5673 175/426 |
| 6,142,250 | A * | 11/2000 | Griffin | E21B 7/068 175/381 |
| 6,935,441 | B2 | 8/2005 | Dykstra | |
| 7,703,557 | B2 | 4/2010 | Durairajan | |
| 7,762,355 | B2 | 7/2010 | McClain | |
| 8,141,665 | B2 * | 3/2012 | Ganz | E21B 10/43 175/432 |

(Continued)

FOREIGN PATENT DOCUMENTS

| | | |
|---|---|---|
| EP | 3 282 084 | 2/2018 |
| WO | 2018/231343 | 12/2018 |

*Primary Examiner* — Kenneth L Thompson

(57) ABSTRACT

A bit for drilling a wellbore includes: a shank having a coupling formed at an upper end thereof; a body mounted to a lower end of the shank; and a cutting face forming a lower end of the bit. The cutting face includes: a blade protruding from the body; a leading cutter including: a substrate mounted in a pocket formed in a leading edge of the blade; and a cutting table made from a superhard material and mounted to the substrate; and a shock stud having a non-planar working portion made from a composite material and mounted in a lower face of the blade at a position trailing the leading cutter. The composite material comprises a ceramic or cermet matrix impregnated with a superhard material.

17 Claims, 6 Drawing Sheets

(56) References Cited

U.S. PATENT DOCUMENTS

| | | | | |
|---|---|---|---|---|
| 8,459,382 | B2 * | 6/2013 | Aliko | E21B 10/62 175/408 |
| 8,794,356 | B2 | 8/2014 | Lyons | |
| 9,140,072 | B2 * | 9/2015 | Nelms | E21B 10/5735 |
| 9,567,807 | B2 | 2/2017 | Green | |
| 9,644,429 | B2 | 5/2017 | Mensa-Wlmot | |
| 10,494,876 | B2 * | 12/2019 | Mayer | E21B 17/1092 |
| 2008/0179108 | A1 * | 7/2008 | McClain | E21B 10/55 175/431 |
| 2012/0012403 | A1 * | 1/2012 | de Rochemont | C23C 28/044 175/434 |
| 2015/0259988 | A1 | 9/2015 | Chen | |
| 2015/0345228 | A1 | 12/2015 | Williams | |
| 2016/0053547 | A1 * | 2/2016 | Samuel | E21B 7/24 175/57 |
| 2017/0081921 | A1 | 3/2017 | Evans | |
| 2018/0291689 | A1 * | 10/2018 | Palmer | E21B 10/55 |
| 2018/0313161 | A1 * | 11/2018 | Savage | E21B 10/5673 |
| 2019/0010764 | A1 * | 1/2019 | Lyons | E21B 10/567 |
| 2019/0100967 | A1 * | 4/2019 | Russell | E21B 10/56 |

* cited by examiner

DRILL BIT HAVING SHAPED IMPREGNATED SHOCK STUDS AND/OR INTERMEDIATE SHAPED CUTTER

BACKGROUND OF THE DISCLOSURE

Field of the Disclosure

The present disclosure generally relates to a drill bit having shaped impregnated shock studs.

Description of the Related Art

EP 3 282 084 discloses a bit for drilling a wellbore includes: a shank having a coupling formed at an upper end thereof; a bit body mounted to a lower end of the shank; a gage section forming an outer portion of the drill bit; and a cutting face forming a lower end of the drill bit. The cutting face includes: a plurality of blades protruding from the bit body, each blade extending from a center of the cutting face to the gage section; a plurality of shear cutters mounted along each blade; and a plurality of rolling cutters. Each rolling cutter includes: a housing mounted to a respective blade; a seat mounted in the housing; and a ball kept between the housing and the seat and having a portion protruding from the housing.

U.S. Pat. No. 4,602,691 discloses an earth boring bit utilizing thermally stable polycrystalline diamond material having a row of closely spaced sharp cutting elements, following by a row of widely spaced, blunt or rounded cutting elements, each cutting element extending from a supporting matrix a predetermined amount to allow the sharp cutting elements to form small relief kerfs in a geological formation, after which the blunt or rounded cutting elements dislodge material between the kerfs. Additionally, cylindrical cutting elements are positioned near the gage or outermost portion of the matrix to enhance gage bore cutting.

U.S. Pat. No. 5,544,713 discloses a cutting element which has a metal carbide stud having a conic tip formed with a reduced diameter hemispherical outer tip end portion of said metal carbide stud. A layer of polycrystalline material, resistant to corrosive and abrasive materials, is disposed over the outer end portion of the metal carbide stud to form a cap. An alternate conic form has a flat tip face. A chisel insert has a transecting edge and opposing flat faces. It is also covered with a PDC layer.

U.S. Pat. No. 5,595,252 discloses a drill bit assembly including a plurality of cutter units, with each cutter unit including a circumferentially forward, relatively blunt positioning cutter, followed by a fixed cutter having a relatively sharp cutting edge, with the cutting edge of the following cutter being positioned a predetermined distance below an operating position of the positioning cutter. Thus, the cutting depth of the following cutter is controlled by the positioning cutter locating the drill bit assembly against the hole end wall from which material is being cut. Also, additional fixed cutters can be provided in circumferential alignment in said cutting units, and liquid jet cutters can be used in combination with said cutting units.

U.S. Pat. No. 6,935,441 discloses a rotary drag bit and method for drilling subterranean formations including a bit body being provided with at least one cutter thereon exhibiting reduced, or limited, exposure to the formation, so as to control the depth-of-cut of the at least one cutter, so as to control the volume of formation material cut per bit rotation, as well as to control the amount of torque experienced by the bit and an optionally associated bottomhole assembly regardless of the effective weight-on-bit are all disclosed. The exterior of the bit preferably includes a plurality of blade structures carrying at least one such cutter thereon and including a sufficient amount of bearing surface area to contact the formation so as to generally distribute an additional weight applied to the bit against the bottom of the borehole without exceeding the compressive strength of the formation rock.

U.S. Pat. No. 7,703,557 discloses a drill bit for drilling a borehole including a bit body having a bit face. In addition, the drill bit includes a plurality of primary blades. Further, the drill bit includes a plurality of primary cutter elements mounted to each primary blade and at least one backup cutter element mounted to each primary blade. Still further, the drill bit includes a plurality of secondary blades. Moreover, the drill bit includes a plurality of primary cutter elements mounted to each secondary blade. The ratio of the total number of backup cutter elements mounted to the plurality of primary blades to the total number of backup cutter elements mounted to the plurality of secondary blades is greater than 2.0. Each backup cutter element on each primary blade has substantially the same radial position as one of the primary cutter elements on the same primary blade.

U.S. Pat. No. 7,762,355 discloses a rotary drag bit includes a primary cutter row having at least one primary cutter, and at least two additional cutters configured relative to one another. In one embodiment, the cutters are backup cutters of a backup cutter group located in respective first and second trailing cutter rows, oriented relative to one another, and positioned to substantially follow the at least one primary cutter. The rotary drag bit life is extended by the backup cutter group, making the bit more durable and extending the life of the cutters. In other of the embodiments, the cutters are configured to selectively engage a subterranean formation material being drilled, providing improved bit life and reduced stress upon the cutters. Still other embodiments of rotary drag bits include backup cutter configurations having different backrake angles and siderake angles, including methods therefor.

U.S. Pat. No. 8,794,356 discloses earth-boring tools include a body, one or more blades projecting outwardly from the body, and cutting elements carried by the blade. The cutting elements include at least one shearing cutting element and at least one gouging cutting element. Methods of forming an earth-boring tool include mounting a shearing cutting element comprising an at least substantially planar cutting face to a body of an earth-boring tool, and mounting a gouging cutting element comprising a non-planar cutting face to the body of the earth-boring tool. The gouging cutting element may be positioned on the body of the earth-boring tool such that the gouging cutting element will gouge formation material within a kerf cut in the formation material by the shearing cutting element, or between kerfs cut in the formation material by a plurality of shearing cutting elements.

U.S. Pat. No. 9,567,807 discloses an earth-boring tool including a bit body, a plurality of first cutting elements, and a plurality of second cutting elements. Each of the first cutting elements includes a discontinuous phase dispersed within a continuous matrix phase. The discontinuous phase includes a plurality of particles of superabrasive material. Each of the second cutting elements includes a polycrystalline diamond compact or tungsten carbide. A method of forming an earth-boring tool includes disposing a plurality of first cutting elements on a bit body and disposing a second plurality of second cutting elements on the bit body. Another method of foaming an earth-boring tool includes forming a body having a plurality of first cutting elements and a plurality of cutting element pockets and securing each of a plurality of second cutting elements within each of the cutting element pockets.

US 2015/0259988 discloses a cutting element including a substrate, an upper surface of the substrate including a crest, the crest transitioning into a depressed region, and an ultrahard layer on the upper surface, thereby forming a non-planar interface between the ultrahard layer and the substrate. A top surface of the ultrahard layer includes a cutting crest extending along at least a portion of a diameter of the cutting element, the top surface having a portion extending laterally away from the cutting crest having a lesser height than a peak of the cutting crest.

US 2015/0345228 discloses a drill bit including at least one blade having a plurality of cutting elements in the form of polycrystalline diamond cutters disposed on a leading edge of the blade, at least one diamond impregnated cutting region, disposed behind the leading edge of the blade, and wherein at least one of the cutters disposed on the leading, edge is an off-tip cutting element, arranged so that it does not engage with the formation during drilling until bit wear has taken place.

US 2017/0081921 discloses an earth-boring tool including primary and secondary cutting elements mounted to a tool body. The secondary cutting elements define a secondary cutting profile. The secondary cutting profile is recessed relative to the primary cutting profile, which is defined by the primary cutting elements. In an unworn condition, the primary cutting elements engage and cut a formation material while the secondary cutting elements do not. Each secondary cutting element includes a flat surface oriented at an angle relative to a longitudinal axis thereof and extending between a front cutting face and a peripheral side surface thereof. The secondary cutting elements are oriented on the tool body such that a surface area of the flat surface thereof will engage the formation material at least substantially simultaneously when the primary cutting elements reach a worn condition. Methods of forming the earth-boring tool and methods of using the earth-boring tool are also disclosed.

SUMMARY OF THE DISCLOSURE

The present disclosure generally relates to a drill bit having shaped impregnated shock studs. In one embodiment, a bit for drilling a wellbore includes: a shank having a coupling formed at an upper end thereof; a body mounted to a lower end of the shank; and a cutting face forming a lower end of the bit. The cutting face includes: a blade protruding from the body; a leading cutter including: a substrate mounted in a pocket formed in a leading edge of the blade; and a cutting table made from a superhard material and mounted to the substrate; and a shock stud having a nonplanar working portion made from a composite material and mounted in a lower face of the blade at a position trailing the leading cutter. The composite material comprises a ceramic or cermet matrix impregnated with a superhard material.

In another embodiment, a bit for drilling a wellbore includes: a shank having a coupling formed at an upper end thereof; a body mounted to a lower end of the shank; and a cutting face forming a lower end of the bit. The cutting face includes: a blade protruding from the body; a leading cutter and a backup cutter, each cutter including: a substrate mounted in a pocket formed in the blade; and a cutting table made from a superhard material and mounted to the substrate; and an intermediate cutter disposed between the leading cutter and the backup cutter and including: a substrate mounted in a pocket formed in the blade; and a cutting table, cap, or head made from a superhard material, mounted to the substrate, and having a shaped cutting feature.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
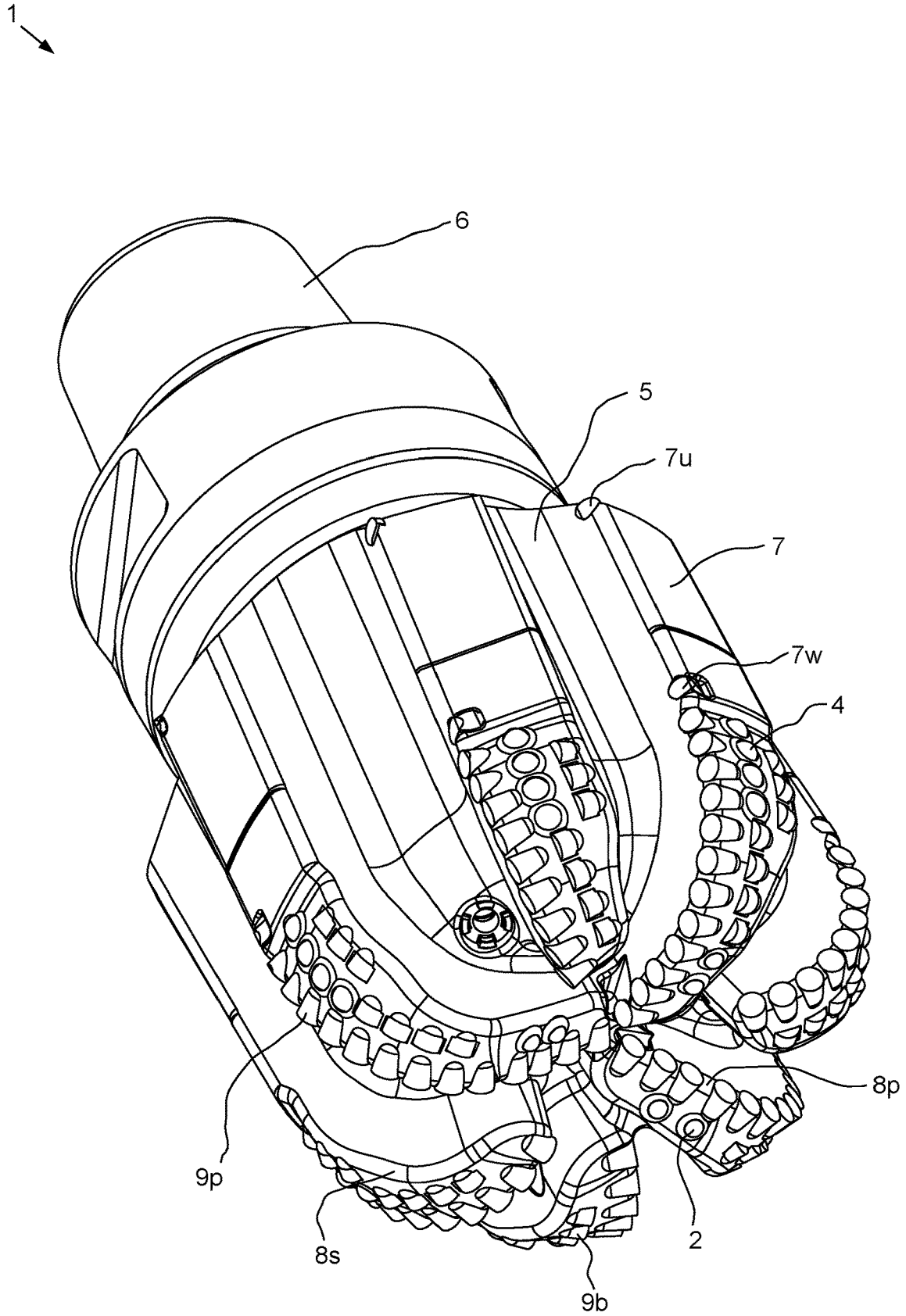
FIG. 1 illustrates a drill bit having shaped impregnated shock studs, according to one embodiment of the present disclosure.
Figure 2:
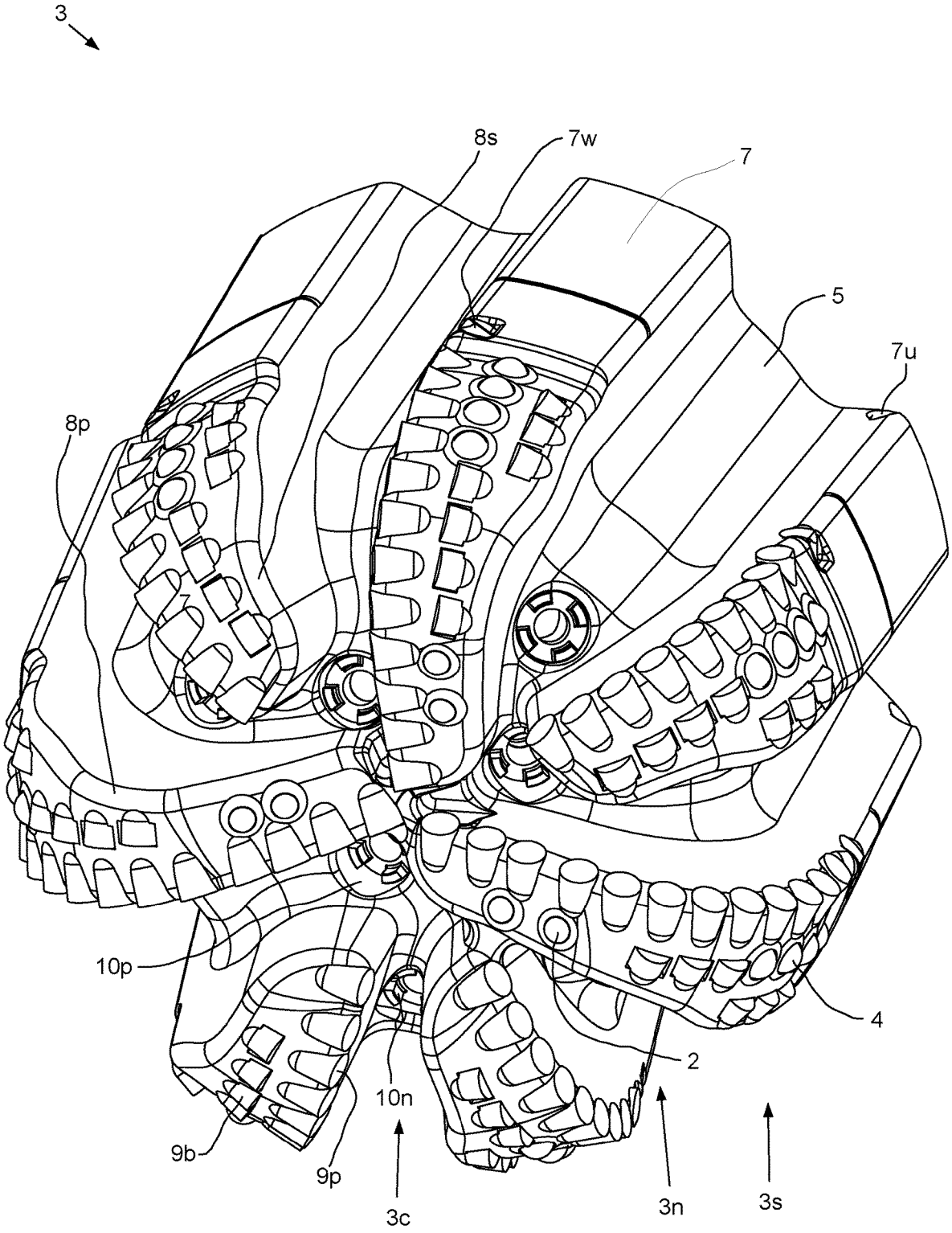
FIG. 2 illustrates a cutting face of the drill bit.

FIG. 1 illustrates a drill bit 1 having shaped impregnated shock studs 2,4, according to one embodiment of the present disclosure. FIG. 2 illustrates a cutting face 3 of the drill bit. The drill bit 1 may include the cutting face 3, a bit body 5, a shank 6, and a gage section 7. A lower portion of the bit body 5 may be made from a composite material, such as a ceramic and/or cermet matrix powder infiltrated by a metallic binder, and an upper portion of the bit body 5 may be made from a softer material than the composite material of the upper portion, such as a metal or alloy shoulder powder infiltrated by the metallic binder. The bit body 5 may be mounted to the shank 6 during molding thereof. The shank 6 may be tubular and made from a metal or alloy, such as steel, and have a coupling, such as a threaded pin, formed at an upper end thereof for connection of the drill bit 1 to a drill collar (not shown). The shank 6 may have a flow bore formed therethrough and the flow bore may extend into the bit body 5 to a plenum (not shown) thereof. The cutting face 3 may form a lower end of the drill bit 1 and the gage section 7 may form at an outer portion thereof.

Alternatively, the bit body 5 may be metallic, such as being made from steel, and may be hardfaced. The metallic bit body may be connected to a modified shank by threaded couplings and then secured by a weld or the metallic bit body may be monoblock having an integral body and shank.

The cutting face 3 may include one or more (three shown) primary blades 8*p*, one or more (four shown) secondary blades 8*s*, fluid courses formed between the blades, leading cutters 9*p*, backup cutters 9*b*, and the impregnated shock studs 2,4. The cutting face 3 may have one or more sections, such as an inner cone 3*c*, an outer shoulder 3*s*, and an intermediate nose 3*n* between the cone and the shoulder sections. The blades 8 may be disposed around the cutting face and each blade may be formed during molding of the bit body 5 and may protrude from a bottom of the bit body. The primary blades 8*p* and the secondary blades 8*s* may be arranged about the cutting face 3 in an alternating fashion. The primary blades 8*p* may each extend from a center of the cutting face 3, across the cone 3*c* and nose 3*n* sections, along the shoulder section 3*s*, and to the gage section 7. The secondary blades 8*s* may each extend from a periphery of the cone section 3*c*, across the nose section 3*n*, along the shoulder section 3*s*, and to the gage section 7. Each blade 8 may extend generally radially across the cone 3*c* (primary only) and nose 3*n* sections with a slight spiral curvature and along the shoulder section 3*s* generally longitudinally with a slight helical curvature.

Each blade 8 may be made from the same material as the lower portion of the bit body 5. The leading cutters 9*p* may be mounted along leading edges of the blades 8*p,s* after infiltration of the bit body 5. The leading cutters 9*p* may be pre-formed, such as by high pressure and temperature sintering, and mounted, such as by brazing, in respective leading pockets formed in the blades 8 adjacent to the leading edges thereof. Each blade 8 may have a lower face 8*f* (FIG. 3A) extending between a leading edge and a trailing edge thereof.

Starting in the nose section 3*n*, each blade 8 may have a first row of backup pockets formed in the lower face 8*f* thereof and extending therealong to the gage section 7. Each first backup pocket may be aligned with or slightly offset from a respective leading pocket. The backup cutters 9*b* may occupy the first backup pockets in the nose section 3*n* and one or two of the first backup pockets in the shoulder section 3*s*. Outer shock studs 4 may occupy the rest of the first backup pockets in the shoulder section 3*s*. For all or almost all of the first backup pockets occupied by the outer shock studs 4, the blades 8 may each have a second row of backup pockets formed in the lower face 8*f* thereof and aligned with or slightly offset from a respective leading pocket. The second rows of backup pockets may be located adjacent to the trailing edges of the blades 8. The backup cutters 9*b* may occupy the second backup pockets in the shoulder section 3*s*. The second rows of backup pockets may extend along a mid-portion of the shoulder section 3*s*.

Alternatively, the first and second backup pockets may extend into or across the nose section 3*n* of the blades 8.

The backup cutters 9*b* may be pre-formed, such as by high pressure and temperature sintering, and mounted, such as by brazing, in respective backup pockets formed in the blades 8. Each cutter 9*p,b* may be a shear cutter and include a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

The inner shock studs 2 may protrude from the lower face 8*f* of each primary blade 8*p* in the cone section 3*c* and may be aligned with or slightly offset from a respective leading cutter 9*p*. The blades 8 may be formed during infiltration of the bit body 5. The shock studs 2,4 may be inserted into a mold (not shown) used to infiltrate the bit body 5 and blades 8 such that the shock studs are mounted to the blades by bonding during infiltration thereof.

Each shock stud 2,4 may be pre-formed from a composite material including a ceramic and/or cermet matrix impregnated with superhard particles. The superhard particles may be diamond, may be synthetic, and may be monocrystalline or polycrystalline. If polycrystalline, the superhard particles may be thermally stable. The diamond may be dispersed therein at a content ranging between twenty-five percent and sixty percent by volume. Each shock stud 2,4 may be formed by sequentially stacking layers of the ceramic and/or cermet and layers of the superhard particles. The stacked layers may then be fused into by infiltration with a metallic binder or hot isostatic pressing (having the binder present in the stacked layers).

Alternatively, each shock stud 2,4 may be formed by additive manufacturing. The additive manufacturing process may include forming a base layer of a metallic cage, inserting the superhard particles into chambers of the base layer; forming an additional layer of the cage; inserting the superhard particles into chambers of the additional layer; and repetition until the cage is complete. Matrix material may then be poured into the cage and then the cage may be infiltrated by a metallic binder or hot isostatic pressed to fuse the components.

Each inner shock stud 2 may include a cylindrical base portion (not shown) and a non-planar working portion. The non-planar working portion may be dome shaped, such as hemi-spherical or hemi-ellipsoidal. The cylindrical base portion may be disposed in the respective pocket and the working portion may extend therefrom such that a bottom of the working portion has a stud exposure below the lower face 8*f*. The inner shock studs 2 may have the stud exposure equal to or less than the respective leading cutters 9*p*.

One or more (six shown) ports 10*p* may be formed in the bit body 5 and each port may extend from the plenum and through the bottom of the bit body to discharge drilling fluid (not shown) along the fluid courses. A nozzle 10*n* may be disposed in each port 10*p* and fastened to the bit body 5. Each nozzle 10*p* may be fastened to the bit body 5 by having a threaded coupling formed in an outer surface thereof and each port 10*p* may be a threaded socket for engagement with the respective threaded coupling. The ports 10*p* may include an inner set of one or more (three shown) ports disposed in the cone section 3*c* and an outer set of one or more (three shown) ports disposed in the nose section 3*n* and/or shoulder section 3*s*. Each inner port 10*p* may be disposed between an inner end of a respective secondary blade 8*s* and the center of the cutting face 3.

The gage section 7 may define a gage diameter of the drill bit 1. The gage section 7 may include a plurality of gage pads, such as one gage pad for each blade 5, and junk slots formed between the gage pads. The junk slots may be in fluid communication with the fluid courses formed between the blades 8. The gage pads may be disposed around the gage section 7 and each pad may be formed during molding of the bit body 5 and may protrude from the outer portion of the bit body. Each gage pad may be made from the same material as the bit body 5 and each gage pad may be formed integrally with a respective blade 8. Each gage pad may extend upward from an end of the respective blade 8 in the shoulder section 3*s* to an exposed outer surface of the shank 6. Each gage pad may include a slightly recessed transition portion located adjacent to the shoulder section 3*s*, a full diameter portion extending from the transition portion, and a tapered portion extending from the full diameter portion to the shank 6.

Each of the transition portion and the tapered portion may have a pocket formed in a leading edge thereof. A lower gage trimmer 7*w* may be mounted in each pocket of the transition portion and an upper gage trimmer 7*u* may be mounted in each pocket of the tapered portion. Each gage trimmer 7*u,w* may be mounted into the respective pocket by brazing and may have a flat formed therein to adjust a size of the drill bit 1. Each gage trimmer 7*u,w* may be a shear cutter and include a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

Alternatively, the gage pads may have gage protectors embedded therein. Each gage protector may be a thermally stable PDC.

Figure 3A:
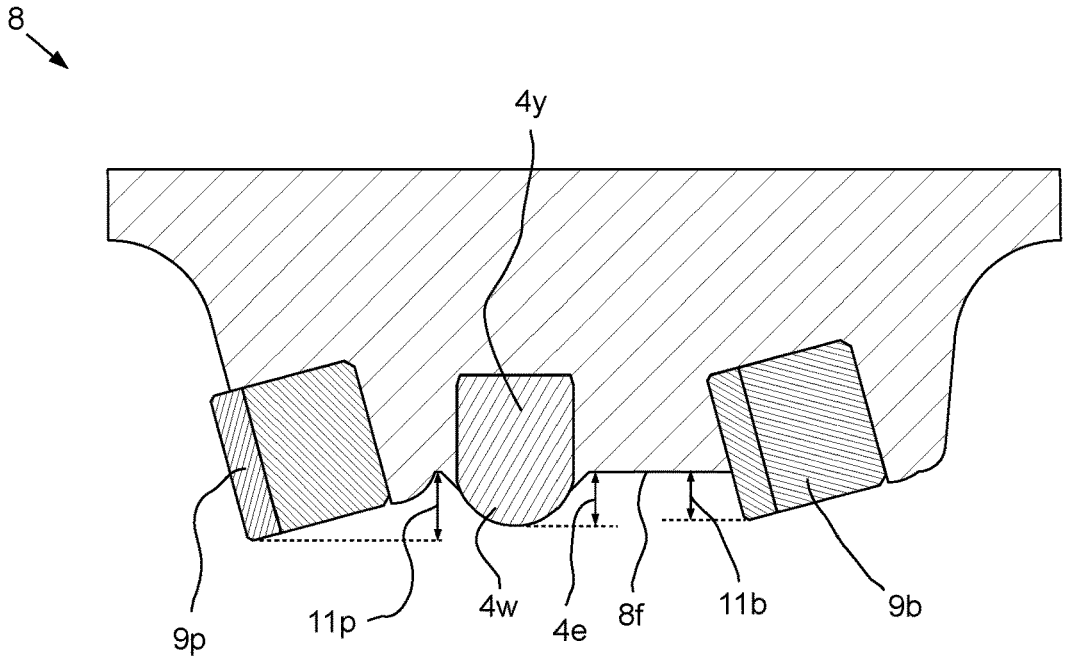
FIG. 3A illustrates a typical blade of the drill bit in the shoulder section.

FIG. 3A illustrates a typical blade 8 of the drill bit 1 in the shoulder section 3*s*. Each outer shock stud 4 may include a cylindrical base portion 4*y* and a non-planar working portion 4*w*. The non-planar working portion 4*w* may be dome shaped, such as hemi-spherical or hemi-ellipsoidal. The cylindrical base portion 4*y* may be disposed in the respective pocket and the working portion 4*w* may extend therefrom such that a bottom of the working portion has a stud exposure 4*e* below the lower face 8*f*. A cutting edge of the respective leading cutter 9*p* may extend below the lower face 8*f* by a leading exposure 11*p* and a cutting edge of the respective backup cutter 9*b* may extend below the lower face by a backup exposure 11*b*. The leading exposure 11*p* may be greater than both the stud exposure 4*e* and the backup exposure 11*b*. The stud exposure 4*e* may be greater than the backup exposure 11*b*.

Each outer shock stud 4 may have a longitudinal axis perpendicular or substantially perpendicular (plus or minus five degrees) to a portion of the lower face 8*f* adjacent thereto. Each inner shock stud 2 may also have a longitudinal axis perpendicular or substantially perpendicular (plus or minus five degrees) to a portion of the lower face 8*f* adjacent thereto.

In use (not shown), the drill bit 1 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1 may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1. The drilling fluid may be discharged by the nozzles 10*n* and carry cuttings up an annulus formed between the drill string and the wellbore and/or between the drill string and a casing string and/or liner string.

Advantageously, the underexposure of the outer shock studs 4 and the respective backup cutters 9*b* relative to the respective leading cutters 9*p* may be beneficial for protection of the backup cutters during drilling of a first formation with hard stringers, such as chert. The outer shock studs 4 may prevent the backup cutters 9*b* from engaging the first formation, thereby protecting the backup cutters from damage by the hard stringers. Once the first formation has been drilled through, the fresh backup cutters 9*b* may be used to drill through a second abrasive formation, such as sand. The outer shock studs 4 may wear quickly during drilling of the second formation to expose the backup cutters 9*b*. The primary cutters 9*p* may have properties optimized for drilling the first formation, such as good impact resistance, and the backup cutters 9*b* may have properties optimized for drilling the second formation, such as good abrasion resistance.

Figure 3B:
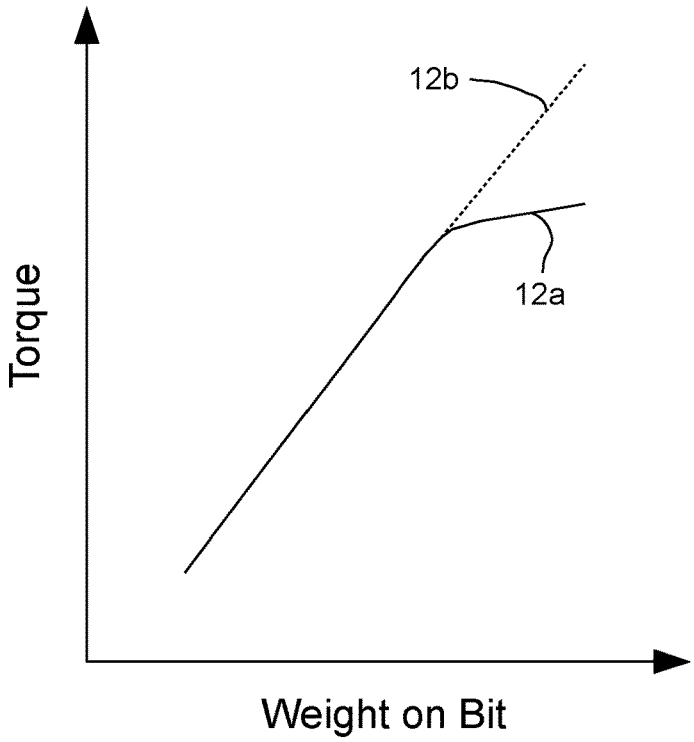
FIG. 3B illustrates performance of inner shock studs.

FIG. 3B illustrates performance of the inner shock studs 2. The primary cutters 9*p* in the cone section 3*c* may be configured with aggressive properties, such as having a relatively high backrake and/or effective backrake angle (not shown). However, use of aggressive primary cutters 9*p* may have the drawback of increased torque of the drill bit 1 during directional drilling especially if weight on bit (WOB) control is lost. This increased torque may overload the rotary drilling motor or steering tool, thereby risking damage thereto and/or loss of tool face control. The nonplanar working surfaces of the inner shock studs 2 may be used to compensate the drawback of the aggressive primary cutters 9*p* by gradually engaging the formation as depth of cut (DOC) increases. As the nonplanar inner shock studs 2 engage the formation, the contact area increases quickly, thereby reducing a rate of increase of torque relative to weight on bit (WOB) as illustrated by curve 12*a*. Line 12*b* is a hypothetical response of a drill bit lacking the nonplanar inner shock studs.

The drill bit 1 may be configured such that the WOB divided by a maximum contact area of the inner shock studs 2 with the formation is greater than a compressive strength of the formation, thereby allowing the inner shock studs to gouge and/or crush the formation.

Alternatively, the drill bit 1 may have only one of the inner 2 and outer 4 shock studs.

Figure 4A:
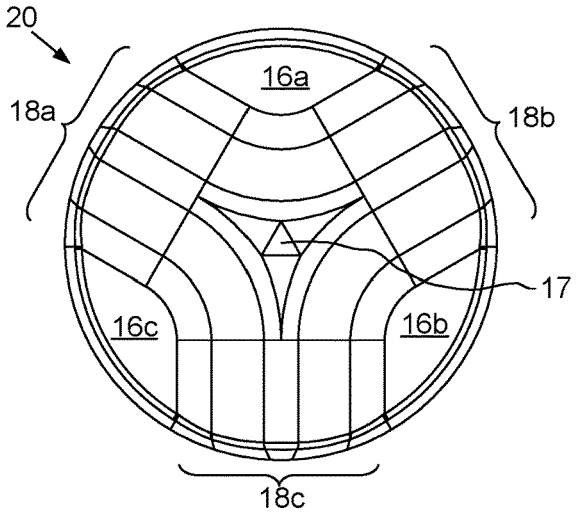
FIGS. 4A-4C illustrate a shaped cutter for use with the drill bit instead of outer shock studs, according to another embodiment of the present disclosure.
Figure 4D:
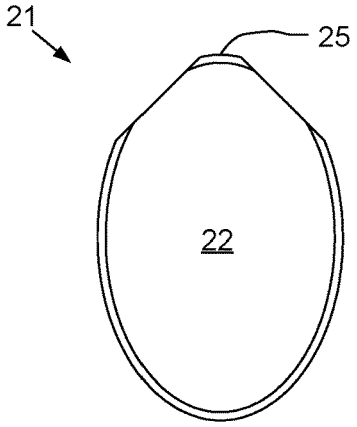
FIGS. 4D and 4E illustrate a second shaped cutter for use with the drill bit instead of the outer shock studs, according to another embodiment of the present disclosure.
Figure 4B:
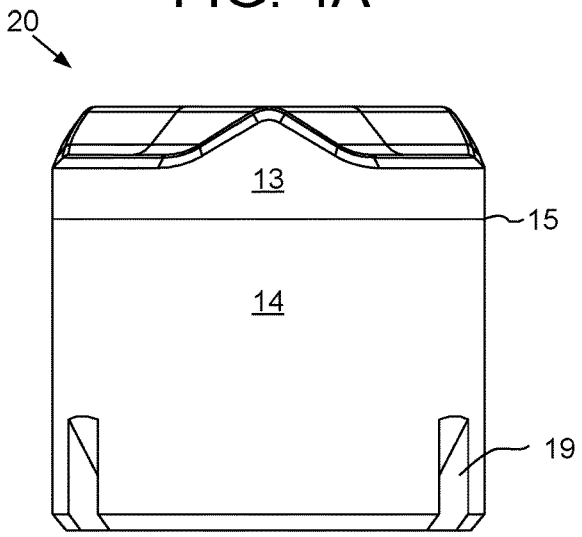
Figure 4E:
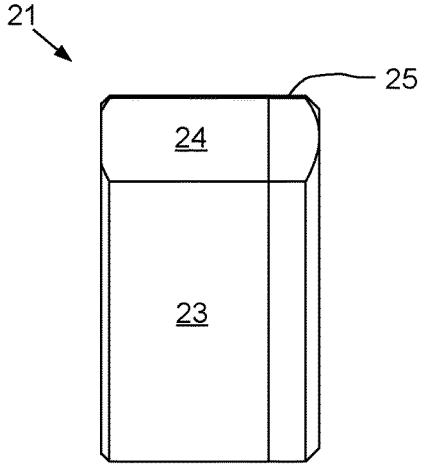
Figure 4C:
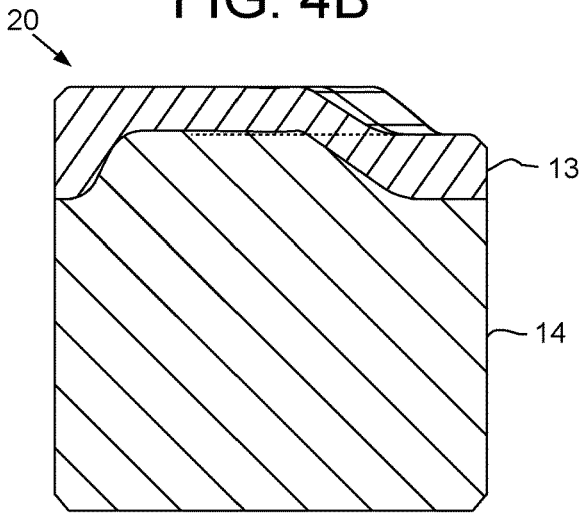

FIGS. 4A-4C illustrate a shaped cutter 20 for use with the drill bit 1 instead of the outer shock studs 4. The drill bit 1 may have a plurality of the shaped cutters 20 for occupying the rest of the first backup pockets in the shoulder section 3*s* instead of the outer shock studs 4. The shaped cutter 20 may include a non-planar cutting table 13 mounted to a cylindrical substrate 14. The cutting table 13 may be made from a superhard material, such as polycrystalline diamond, and the substrate 14 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt.

The cutting table 13 may have an interface 15 with the substrate 14 at a lower end thereof and the working face at an upper end thereof. The working face may have a plurality of recessed bases 16*a-c*, a protruding center section 17, a plurality of protruding ribs 18*a-c*, and an outer edge. Each base 16*a-c* may be planar and perpendicular to a longitudinal axis of the shaped cutter 2. The bases 16*a-c* may be located between adjacent ribs 18*a-c* and may each extend inward from a side of the cutting table 13. The outer edge may extend around the working face and may have constant geometry. The outer edge may include a chamfer located adjacent to the side and a round located adjacent to the bases 16*a-c* and ribs 18*a-c*.

Each rib 18*a-c* may extend radially outward from the center section 17 to the side of the cutting table 13. Each rib 18*a-c* may be spaced circumferentially around the working face at regular intervals, such as at one-hundred twenty degree intervals. Each rib 18*a-c* may have a triangular profile formed by a pair of curved transition surfaces, a pair of linearly inclined side surfaces, and a round ridge. Each transition surface may extend from a respective base 16*a-c* to a respective side surface. Each ridge may connect opposing ends of the respective side surfaces. An elevation of each ridge may be constant (shown), declining toward the center section, or inclining toward the center section.

An elevation of each ridge may range between twenty percent and seventy-five percent of a thickness of the cutting table 13. A width of each rib 18*a-c* may range between twenty and sixty percent of a diameter of the cutting table 13. A radial length of each rib 18*a-c* from the side to the center section 17 may range between fifteen and forty-five percent of the diameter of the cutting table 13. An inclination of each side surface relative to the respective base 16*a-c* may range between fifteen and fifty degrees. A radius of curvature of each ridge may range between one-eighth and five millimeters or may range between one-quarter and one millimeter.

The center section 17 may have a plurality of curved transition surfaces, a plurality of linearly inclined side surfaces, and a plurality of round edges. Each set of the features may connect respective features of one rib 18*a-c* to respective features of an adjacent rib along an arcuate path. The elevation of the edges may be equal to the elevation of the ridges. The center section 17 may further have a plateau formed between the edges. The plateau may have a slight dip formed therein.

The substrate 14 may have the interface 15 at an upper end thereof and a lower end for being received in the respective leading cutter pocket. The substrate upper end may have a planar outer rim, an inner mound for each rib 18*a-c*, and a shoulder connecting the outer rim and each inner mound. A shape and location of the mounds may correspond to a shape and location of the ribs 18*a-c* and a shape and location of the outer rim may correspond to a shape and location of the bases 16*a-c* except that the mounds may not extend to a side of the substrate 14. Ridges of the mounds may be slightly above the bases 16*a-c* (see dashed line in FIG. 4C), level with or slightly below the bases. A height of the mounds may be greater than an elevation of the ribs 18*a-c*. The substrate 14 may have a keyway 19 formed therein for each ridge of the respective rib 18*a-c*. Each keyway 19 may be located at the edge of the substrate 14 and may extend from the pocket end thereof along a portion of a side thereof. Each keyway 19 may be angularly offset from the associated ridge, such as being located opposite therefrom.

Each appropriate backup pocket of the drill bit 1 may have a key (not shown) formed therein for properly orienting the respective shaped cutter 20. During brazing of each shaped cutter 20 into the respective pocket, one of the keyways 19 may be aligned with the key and engaged therewith to obtain the proper orientation. The proper orientation may be that a centerline of the operative ridge is tangential to a radial axis extending from a center of the cutting face to the center section 17 and that the operative ridge faces toward the respective leading cutter 9*p*.

Alternatively, the key and keyway 19 may be omitted and the substrate 14 may have one or more grooves formed in a side thereof, such as a groove for each ridge. Each groove may be aligned with the respective ridge and used for visual orientation by a technician during brazing of the shaped cutter 20 into the pocket.

FIGS. 4D and 4E illustrate a second shaped cutter 21 for use with the drill bit 1 instead of the outer shock studs 4, according to another embodiment of the present disclosure. The drill bit 1 may have a plurality of the second shaped cutters 21 for occupying the rest of the first backup pockets in the shoulder section 3*s* instead of the outer shock studs 4. The second shaped cutter 21 may include a planar cutting table 22 mounted to a substrate 23. The cutting table 22 may be made from a superhard material, such as polycrystalline diamond, and the substrate 23 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt.

The second shaped cutter 21 may initially be formed with an elliptical-cylindrical or circular-cylindrical shape, such as by high pressure and high temperature sintering. Once sintered, a pair of recesses 24 may be machined into a periphery of the second shaped cutter 21 to impart a scribe-shape. The machining may be done by electrical discharge machining or with a laser. The recesses 24 may each be formed along both the substrate 23 and the cutting table 22. The scribe shape may include a rounded or sharp operative edge 25. The substrate 23 may have a keyway (not shown) formed therein for the operative edge 25. The keyway may be located at the edge of the substrate 23 and may extend from the pocket end thereof along a portion of a side thereof. The keyway may be angularly offset from the operative edge 25, such as being located opposite therefrom.

Each appropriate backup pocket of the drill bit 1 may have a key (not shown) formed therein for properly orienting the respective second shaped cutter 21. During brazing of each second shaped cutter 21 into the respective pocket, the keyway may be aligned with the key and engaged therewith to obtain the proper orientation. The proper orientation may be that a centerline of the operative edge 25 is tangential to a radial axis extending from a center of the cutting face to a center of the cutting table 22 and that the operative ridge faces toward the respective leading cutter 9*p*.

Alternatively, the key and keyway may be omitted and the substrate 23 may have a groove formed in a side thereof. Each groove may be aligned with the respective ridge and used for visual orientation by a technician during brazing of the second shaped cutter 21 into the pocket.

Figure 5A:
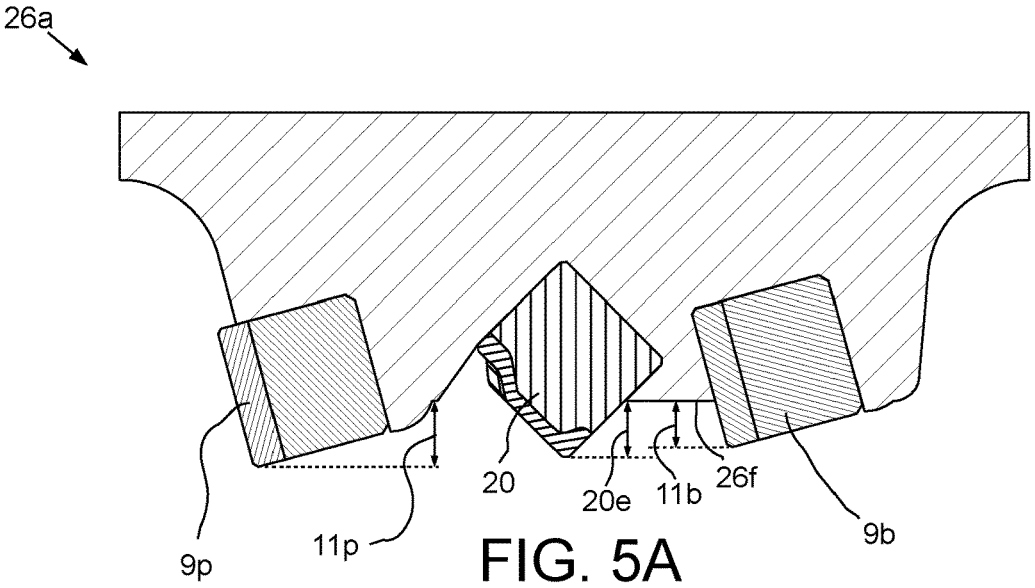
FIGS. 5A-5C illustrate shoulder sections of alternative blades for use with the drill bit and having the shaped cutter, according to other embodiments of the present disclosure.
Figure 5B:
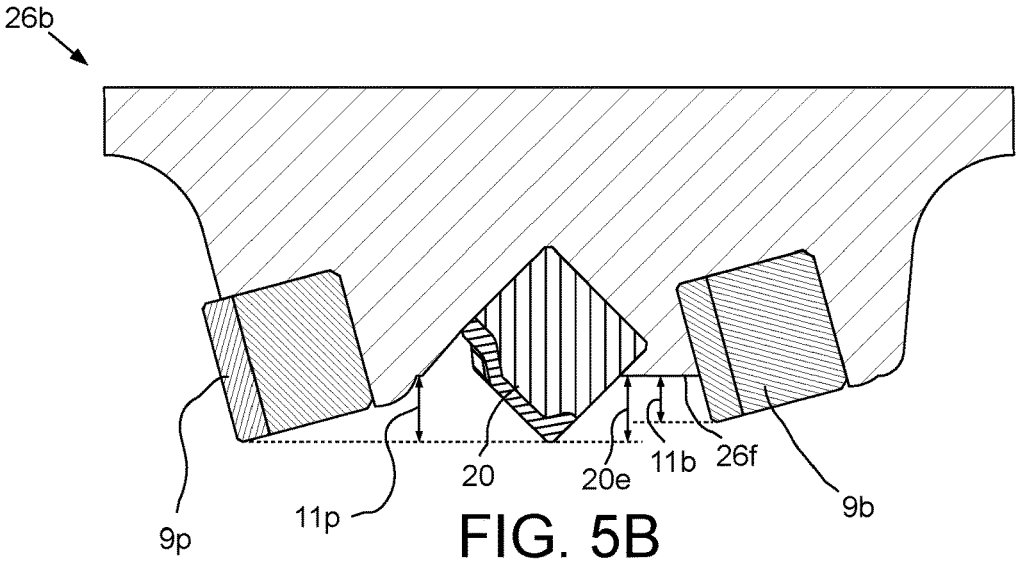
Figure 5C:
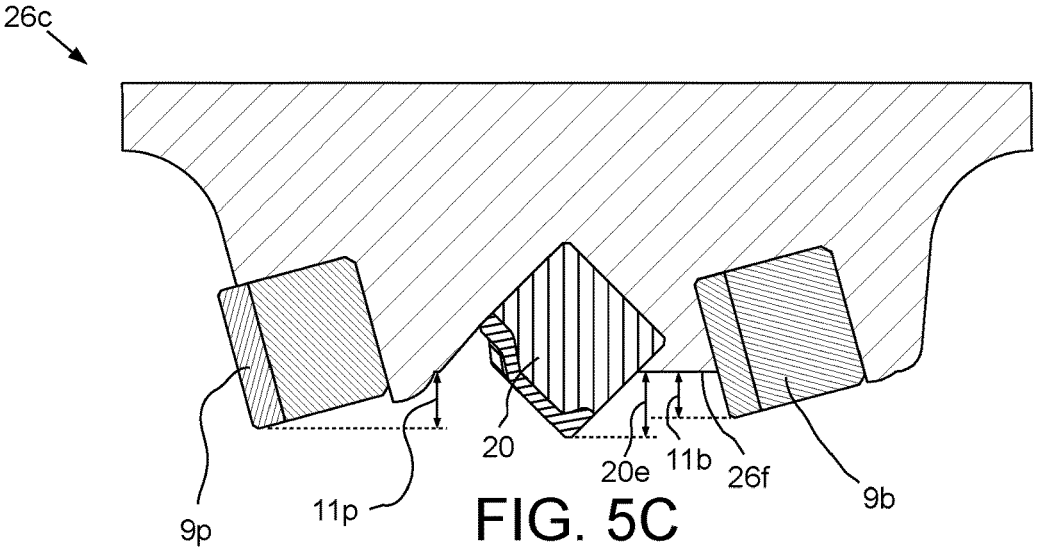

FIGS. 5A-5C illustrate shoulder sections of alternative blades 26*a-c* for use with the drill bit 1 and having the shaped cutter 20, according to other embodiments of the present disclosure. Any one of the alternative blades 26*a-c* may replace the blades 8 in the drill bit 1. Each of the leading cutter 9*p* and the backup cutter 9*b* may be inclined at a first back rake angle and the shaped cutter 20 may be inclined at a second back rake angle. The second back rake angle may be greater than the first back rake angle. The first back rake angle may range between ten and thirty degrees and the second back rake angle may be greater than thirty degrees and less than ninety degrees.

A cutting edge of the operative ridge of the shaped cutter 20 may extend below a lower face 26*f* of the alternative blades 26*a-c* by an intermediate exposure 20*e*. Referring specifically to FIG. 5A, the leading exposure 11*p* may be greater than both the intermediate exposure 20*e* and the backup exposure 11*b* and the intermediate exposure 20*e* may be greater than the backup exposure 11*b*. Referring specifically to FIG. 5B, the leading exposure 11*p* may be equal to the intermediate exposure 20*e* and both the leading exposure and the intermediate exposure may be greater than the backup exposure 11*b*. Referring specifically to FIG. 5C, the leading exposure 11*p* may be less than the intermediate exposure 20*e* and both the leading exposure and the intermediate exposure may be greater than the backup exposure 11*b*.

Alternatively, the intermediate exposure 20*e* may be equal to the backup exposure 11*b*. Alternatively, the stud exposure 4*e* may be equal to the backup exposure 11*b*. Alternatively, the second shaped cutter 21 may be used with the alternative blades 26*a-c* instead of the shaped cutter 20.

Advantageously, cutting efficiency of the drill bit 1 may be increased with use of the outer shock studs 4 or shaped cutters 20, 21 since the outer shock studs or shaped cutters add a gouging/crushing action to the shearing action of the backup cutters 9*b*. This gouging/crushing action may pre-weaken the formation, thereby facilitating the shearing action by the backup cutters 9*b*. Referring to the shaped cutters 20, 21, the greater backrake angle thereof may increase durability thereof by keeping the respective cutting tables 13, 22 in compression.

Alternatively, the drill bit 1 may have webs extending between the primary blades 8*p* and the secondary blades 8*s* in order to partition the fluid courses and curved nozzles instead of the nozzles 10*n* for directing the discharged drilling fluid along the partitioned fluid courses. Alternatively, the outer shock studs 4 or shaped cutters 20, 21 may occupy all of the first backup pockets.

Figure 6A:
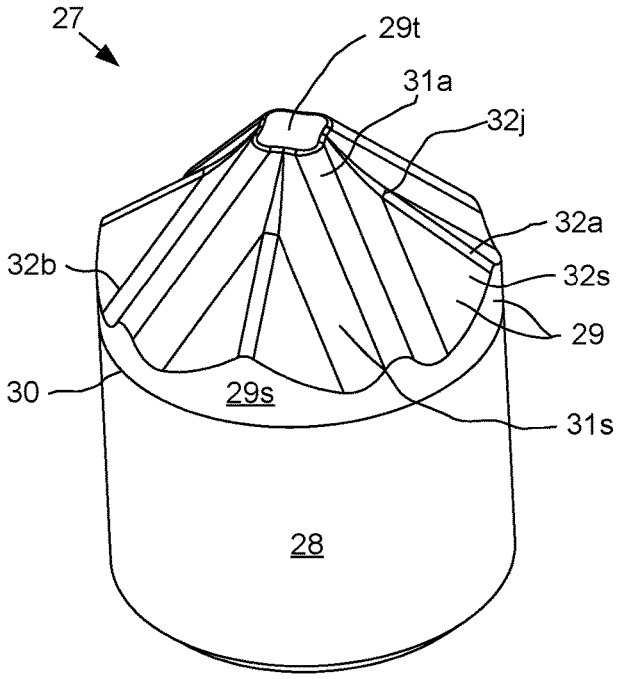
FIGS. 6A and 6B illustrate a third shaped cutter, according to another embodiment of the present disclosure.
Figure 6B:
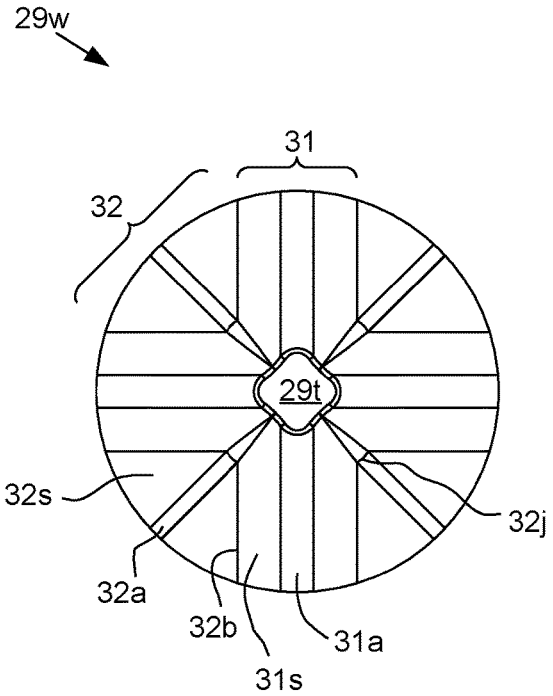

FIGS. 6A and 6B illustrate a third shaped cutter 27, according to another embodiment of the present disclosure. The drill bit 1 may have a plurality of the third shaped cutters 27 for occupying the rest of the first backup pockets in the shoulder section 3*s* instead of the outer shock studs 4. The third shaped cutter 27 may include a substrate 28 and a cap 29 mounted to the substrate. The cap 29 may be made from a polycrystalline superhard material, such as polycrystalline diamond (PCD), and the substrate may be made from a hard material, such as a cermet. The cermet may be a cemented carbide, such as a group VIIIB metal-tungsten carbide. The group VIIIB metal may be cobalt. The third shaped cutter 27 may be manufactured by a high pressure, high temperature (HPHT) sintering operation using either a belt press or a cubic press. A working face 29*w* may then be formed in the cap 29 such as by laser cutting or electrical discharge machining.

The cap 29 may have an interface 30 with the substrate 28, the working face 29*w* at an end thereof opposite to the interface, and a round periphery 29*s* connecting the interface and the working face. The substrate 28 may have the interface 30 with the cap 29 and a mounting end opposite to the interface for being received in the first backup pocket of the drill bit 1. The mounting end of the substrate 28 may have a chamfer formed in a periphery thereof. The interface 30 may have a planar base, a planar central tip, and a conical shoulder connecting the base and the tip. The interface 30 may be located in a conical portion of the substrate 28 and the mounting end may be located in a cylindrical portion of the substrate.

The cap 29 may have a central tip 30*t* formed in the working face 29*w* thereof and elevated at a height above a maximum height of the periphery 29*s*. A height of the tip 29*t* above the base of the interface 30 may range between one-fifth and four-fifths of a length of the third shaped cutter 27. The cap 29 may include a plurality of plows 31 (four shown) formed in the working face 29*w* thereof and a plurality of ribs 32 (four shown) formed in the working face thereof. The plows 31 and the ribs 32 may be arranged around the working face 29*w* in an alternating fashion. The plows 31 and the ribs 32 may each extend from the periphery 29*s* of the cap 29 transversely inward and longitudinally upward to the tip 29*t*. The tip 29*t* may be flat, may have a round-rectangular, such as round-square, shape, and may have rounded edge with a radius ranging between one-tenth of a millimeter and one-half of a millimeter. The tip 29*t* may have a diagonal extending between the round corners with a length ranging between ten percent and forty percent of a diameter of the cap 29.

At the periphery 29*s* of the cap 29, each rib 32 may have a triangular shape. At the periphery 29*s* of the cap 29, each rib 32 may have a pair of base edges 32*b* and an apical edge 32*a* elevated above the base edges. Each rib 32 may also have a pair of sides 32*s* formed between the respective base edges 32*b* and the respective apical edge 32*a*. The sides 32*s* may each be triangular and each apical edge 32*a* may be convex. Each apical edge 32*a* may also be elevated above the respective sides 32*s* at the periphery 29*s* of the cap 29. Each base edge 32*b* and each side 32*s* may converge toward the apical edge 32*a* as the respective rib 32 extends from the periphery 29*s* of the cap 29 to a respective junction 32*j* located between the periphery of the cap and the tip 29*t* thereof. Each apical edge 32*a* may extend with a constant shape and with a constant radial slope from the periphery 29*s* to the respective junction 32*j*. Each apical edge 32*a* may then radially converge and extend with an exponential radial slope from the respective junction 32*j* to the tip 29*t*. Each apical edge 32*a* may then terminate at a side of the tip 29*t*. Each apical edge 32*a* may be round with a radius 33*c* ranging between one-quarter of a millimeter and one millimeter.

The plows 31 may have a different shape from a shape of the ribs 32. At the periphery 29*s* of the cap 29, each plow 31 may have a sinusoidal shape. Each plow 31 may share one of the base edges 32*b* of each adjacent rib 32 and may have an apical edge 31*a* elevated above the base edges. At the periphery 29*s* of the cap 29, a height of each rib apical edge 32*a* above the interface 30 may be greater than a height of each plow apical edge 31*a* there-above and a circumferential width of each rib may be greater than a circumferential width of each plow. Each plow 31 may also have a pair of sides 31*s* and each plow apical edge 31*a* may also be elevated above the respective sides 31*s* at the periphery 29*s* of the cap 29. From the periphery 29*s* of the cap 29 to the junctions 32*j*, the sides 31*s* of each plow 31 may be formed between the respective base edges 32*b* and the respective apical edge 31*a*. Each plow side 31*s* may be concave and the apical edge 31*a* thereof may be convex. Each plow apical edge 31*a* may extend from the periphery 29*s* to the tip 29*t* with a constant shape and with a constant radial inclination angle. The radial inclination angle may range between twenty degrees and sixty degrees. Each plow apical edge 31*a* may then terminate at a respective round corner of the tip 29*t*. Each plow apical edge 31*a* may be round with a radius ranging between three-eighths of a millimeter and one point five millimeters.

Each plow side 31*s* may extend with a constant shape and with a constant radial slope from the periphery 29*s* of the cap 29 to the respective junction 32*j*. Each plow side 31*s* may then be formed between the adjacent rib apical edge 32*a* and the adjacent plow apical edge 31*a* from the respective junction 32*j* to the tip 29*t*. Each plow side 31*s* may then terminate at a side of the tip 29*t*. Each plow side 31*s* may have a fillet with a radius ranging between one millimeter and four millimeters. Each plow 31 may have a maximum thickness at the apical edge 31*a* ranging between one millimeter and four millimeters. The maximum thickness may be constant except for portions thereof adjacent to the periphery 29*s* of the cap 29 and the tip 29*t* of the working face 29*w*.

Alternatively, the tip 29*t* may be rounded or sharp. Alternatively, each plow side 31*s* may be polygonal instead of concave with a circumferential inclination angle ranging between thirty degrees and eighty degrees. Alternatively, the third shaped cutter 27 may include a cylindrical substrate instead of the conical substrate 28 and a head instead of the cap 29. The head may be made from the impregnated material, discussed above and the interface between the head and the cylindrical substrate may be planar.

Figure 6C:
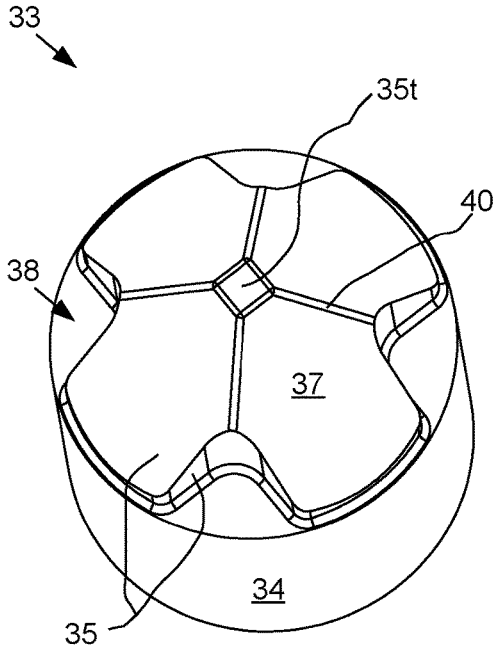
FIGS. 6C and 6D illustrate a second shaped impregnated shock stud, according to another embodiment of the present disclosure.
Figure 6D:
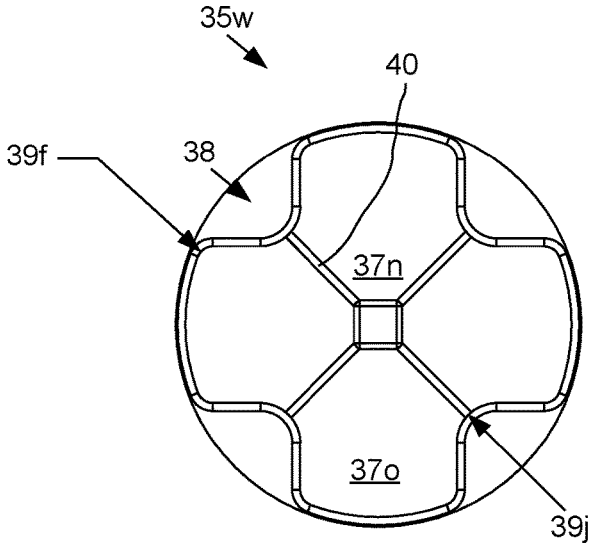

FIGS. 6C and 6D illustrate a second shaped impregnated shock stud, according to another embodiment of the present disclosure. The second shock stud may be used with the drill bit 1 instead of the inner 2 and/or outer 4 shock studs. The second shock stud 33 may include a cylindrical substrate 34 and a head 35 mounted to the substrate. The head 35 may be made from the impregnated material, discussed above. The substrate 34 may be made from the same material discussed above for the substrate 28. The second shock stud 33 may be manufactured by a hot isostatic pressing operation. A working face 35*w* may then be formed in the head 35 such as by laser cutting or electrical discharge machining.

The head 35 may have an interface with the substrate 34, the working face 35*w* at an end thereof opposite to the interface. The substrate 34 may have the interface with the head 35 and a mounting end opposite to the interface for being received in the pocket of the drill bit 1. The mounting end of the substrate 34 may have a chamfer formed in a periphery thereof. The interface may be planar. To facilitate manufacturing, the substrate 34 may have a lip extending along a periphery thereof between the interface and the chamfer.

The head 35 may include a plurality of pads 37 (four shown) and a plurality of slots 38 (four shown). The pads 37 and the slots 38 may be arranged around the head 35 in an alternating fashion. Each pad 37 may extend from the periphery of the substrate 34 transversely inward and longitudinally upward to a tip 35*t* of the working face 35*w*. The tip 35*t* may be flat or slightly convex, may have a rectangular, such as square, shape, and may have rounded edge with a radius ranging between one-tenth of a millimeter and one-half of a millimeter. If the tip is 35*t* slightly convex, the tip may have a large radius, such as greater than or equal to one-half of a diameter of the substrate 34. The tip 35*t* may have a width ranging between five percent and twenty-five percent of a diameter of the substrate 34. An elevation of the tip 35*t* above the interface may be a maximum height of the working face 35*w*. The height of the tip 35*t* above the interface may range between one-third and one hundred percent of a length of the substrate 34.

The pads 37 may be separated by the slots 38 and by protruding borders 40 formed in the working face 35*w*. Each pad 37 may have a rectangular outer portion 37*o* and a triangular inner portion 37*n*. The outer portions may be separated by the slots 38 and the inner portions 37*n* may be separated by the protruding borders 40. The protruding borders 40 may each be rounded or chamfered. The working face of each pad 37 may extend from the periphery of the substrate 34 to the tip 35*t* with a constant radial inclination angle. The radial inclination angle may range between twenty degrees and sixty degrees. Each pad 37 may then terminate at a side of the tip 35*t*. Each pad 37 may have a round base edge extending from the interface and having a radius ranging between one-tenth and one-half of a millimeter. Each outer portion 37*o* of the respective pad 37 may have a round outer edge conforming to the periphery of the substrate 34, a pair of transversely extending sides, and rounded corners connecting the edge and the sides. The base edge of each pad 37 at the rounded corners may have a radius 39*f* ranging between one-quarter of a millimeter and one millimeter.

Each slot 38 may extend from the periphery of the substrate 34 transversely inward by a radial distance ranging between one-tenth and four-tenths of a diameter of the substrate 34*s*. Each slot 38 may expose an upper face of the substrate 34 and have a maximum height located adjacent to a respective border 40. The maximum height may range between three-tenths and eight-tenths of the height of the tip 35*t* above the interface. The base edge of each pad 37 adjacent to the respective slot 38 may have a parabolic shape with a lower vertex having a radius 39*j* ranging between five-eighths of a millimeter and two point five millimeters. Each slot 38 may also have an upper vertex adjacent to the working face of the respective pad 37. Each border 40 may extend from the upper vertex of the respective slot 38 and may terminate at a respective rounded corner of the tip 35*t*.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a shank having a coupling formed at an upper end thereof;

a body mounted to a lower end of the shank; and a cutting face forming a lower end of the bit and comprising:

a blade protruding from the body;

a leading cutter comprising:

a substrate mounted in a pocket formed in a leading edge of the blade; and a cutting table made from a superhard material and mounted to the substrate; and a shock stud having a nonplanar working portion made from a composite material and mounted in a lower face of the blade at a position trailing the leading cutter, wherein:

the composite material comprises a ceramic or cermet matrix impregnated with a superhard material, the nonplanar working portion has a shape selected from a group consisting of hem i-spherical and hemi-ellipsoidal, the cutting face has an inner cone section, an outer shoulder section, and an intermediate nose section, the cutting face further comprises a plurality of the leading cutters and a plurality of backup cutters, the plurality of the leading cutters and the plurality of the backup cutters extend along a portion of the blade, the bit further comprises a plurality of the shock studs, and each shock stud is disposed between a respective leading cutter and a respective backup cutter.

2. The bit of claim 1, wherein the portion of the blade is in the shoulder section.

3. The bit of claim 2, wherein:

each shock stud is less exposed relative to the respective leading cutter, each shock stud is equally or more exposed relative to the respective backup cutter.

4. The bit of claim 3, wherein the bit further comprises another shock stud located in the cone section.

5. The bit of claim 1, wherein each shock stud has a longitudinal axis perpendicular or substantially perpendicular to a portion of a lower face of the blade adjacent thereto.

6. The bit of claim 1, wherein each shock stud is less exposed relative to the respective leading cutter.

7. A method of drilling a wellbore using the bit of claim 1, comprising:

connecting a bit to a bottom of a pipe string, thereby forming a drill string, wherein the bit comprises:

a shank having a coupling formed at an upper end thereof;

a body mounted to a lower end of the shank; and a cutting face forming a lower end of the bit and comprising:

a blade protruding from the body;

a leading cutter comprising:

a substrate mounted in a pocket formed in a leading edge of the blade; and a cutting table made from a superhard material and mounted to the substrate; and a shock stud having a nonplanar working portion made from a composite material and mounted in a lower face of the blade at a position trailing the leading cutter, wherein:

the composite material comprises a ceramic or cermet matrix impregnated with a superhard material, and the nonplanar working portion has a shape selected from a group consisting of hemi-spherical and hem i-ellipsoidal;

lowering the drill string into the wellbore until the bit is proximate a bottom thereof;

rotating the bit and injecting drilling fluid through the drill string; and exerting weight on the bit, wherein the shock stud gradually engages a formation adjacent to the wellbore for protecting a drilling motor connected to the bit or an adjacent backup cutter.

8. A bit for drilling a wellbore, comprising:

a shank having a coupling formed at an upper end thereof;

a body mounted to a lower end of the shank; and a cutting face forming a lower end of the bit and comprising:

a blade protruding from the body;

a leading cutter and a backup cutter, each cutter comprising:

a substrate mounted in a pocket formed in the blade; and a cutting table made from a superhard material and mounted to the substrate; and an intermediate cutter disposed between the leading cutter and the backup cutter and comprising:

a substrate mounted in a pocket formed in the blade; and a cutting table, cap, or head made from a superhard material, mounted to the substrate, and having a shaped cutting feature, wherein:

the cutting feature is a ridge protruding from a working face of the intermediate cutter, the working face has a plurality of protruding ridges spaced therearound, each ridge is part of a respective rib, each rib extends radially outward from a center section to a side of the cutting table, and each rib has a triangular profile formed by a pair of inclined side surfaces and the respective ridge connecting opposing ends of the respective side surfaces.

9. The bit of claim 8, wherein:

a keyway is formed in the substrate of the intermediate cutter, and a key is formed in the pocket of the intermediate cutter and engaged with the keyway.

10. The bit of claim 8, wherein a back rake angle of the intermediate cutter is greater than thirty degrees and less than ninety degrees.

11. The bit of claim 8, wherein:

an exposure of the intermediate cutter is greater than an exposure of the backup cutter, and an exposure of the leading cutter is greater than the exposure of the backup cutter.

12. The bit of claim 11, wherein the exposure of the intermediate cutter is less than the exposure of the leading cutter.

13. The bit of claim 11, wherein the exposure of the intermediate cutter is equal to the exposure of the leading cutter.

14. The bit of claim 11, wherein the exposure of the intermediate cutter is greater than the exposure of the leading cutter.

15. The bit of claim 8, wherein the leading cutter and the backup cutter are shear cutters.

16. The bit of claim 8, wherein an elevation of the ridges is constant.

17. The bit of claim 8, wherein the working face further has a plurality of recessed bases located between adjacent ribs and each base extends inward from the side of the cutting table.

* * * * *